US005485942A

United States Patent [19]

Foster

[11] Patent Number: 5,485,942

[45] Date of Patent: Jan. 23, 1996

[54] LIQUID DISPENSER ASSEMBLY WITH CONTAINER HAVING A SLOPED HANDLE

[75] Inventor: Donald D. Foster, St. Charles, Mo.

[73] Assignee: Contico International, Inc., St. Louis, Mo.

[21] Appl. No.: 358,692

[22] Filed: Dec. 19, 1994

Related U.S. Application Data

[62] Division of Ser. No. 227,565, Apr. 14, 1994, Pat. No. 5,373,973, which is a continuation of Ser. No. 984,876, Dec. 2, 1992, abandoned, which is a continuation-in-part of Ser. No. 829,759, Jan. 31, 1992, abandoned.

[51] Int. Cl.[6] ..... B67D 5/42

[52] U.S. Cl. ..... 222/324; 222/383.1; 222/365; 220/756; 220/771; 215/398; 239/288.3; 239/375

[58] Field of Search ..... 220/756, 771; 215/100 A; 239/333, 288.3, 288.5, 375; 222/179.5, 323, 324, 382, 383.1, 385, 464, 465.1, 527, 530, 538

[56] References Cited

U.S. PATENT DOCUMENTS

| | | | |
|---|---|---|---|
| D. 270,137 | 8/1983 | McDonald et al. | D9/376 |
| D. 271,748 | 12/1983 | McDonald et al. | D9/376 |
| D. 275,934 | 10/1984 | Wassergord et al. | D9/376 |
| D. 326,052 | 5/1992 | Beechuk et al. | D9/528 |
| D. 329,977 | 10/1992 | Armitage et al. | D9/349 |
| D. 332,747 | 1/1993 | Darr et al. | D9/520 |
| D. 332,748 | 1/1993 | Reece et al. | D9/528 |
| D. 335,454 | 5/1993 | McLean et al. | D9/528 |
| D. 344,235 | 2/1994 | Bridger et al. | D9/528 |
| 3,372,846 | 3/1968 | Berkus | 222/538 X |
| 3,744,656 | 7/1973 | Wolfram | 215/100 A X |
| 3,927,797 | 12/1975 | Flider | 220/771 X |
| 4,016,995 | 4/1977 | Frazer | 215/100 A X |
| 4,125,207 | 11/1978 | Ernst et al. | 220/771 X |
| 4,479,589 | 10/1984 | Ford | 222/153 |
| 4,541,529 | 9/1985 | Hestehave et al. | 220/771 X |
| 4,805,793 | 2/1989 | Brandt et al. | 215/100 A X |
| 4,946,053 | 8/1990 | Conrad | 220/771 X |
| 5,219,098 | 6/1993 | Tada | 222/153 |
| 5,222,632 | 6/1993 | Tada | 222/153 |

FOREIGN PATENT DOCUMENTS

| | | | |
|---|---|---|---|
| 576978 | 5/1958 | Italy | 220/771 |

*Primary Examiner*—Andres Kashnikow
*Assistant Examiner*—Kenneth Bomberg
*Attorney, Agent, or Firm*—Rogers, Howell & Haferkamp

[57] ABSTRACT

A dispenser assembly for dispensing liquid from a container has a dispenser operable remotely from the container by way of a tube communicating the dispenser and the liquid within the container. The dispenser assembly has a hand-held dispenser and a tube connected to the dispenser for extension into the liquid within the container. The dispenser is operable to dispense liquid from the container by way of the tube. An adaptor is secured to the container with the tube operable for extending from the dispenser, through the adaptor, and into the container. With the dispenser disconnected from the adaptor and with the adaptor secured to the container, the dispenser may be operated remotely from the container to dispense the liquid from the container. The container has a crown formed in a top wall which projects adjacent to and beyond the dispenser when the dispenser is secured to the container top wall.

15 Claims, 7 Drawing Sheets

FIG. 2.
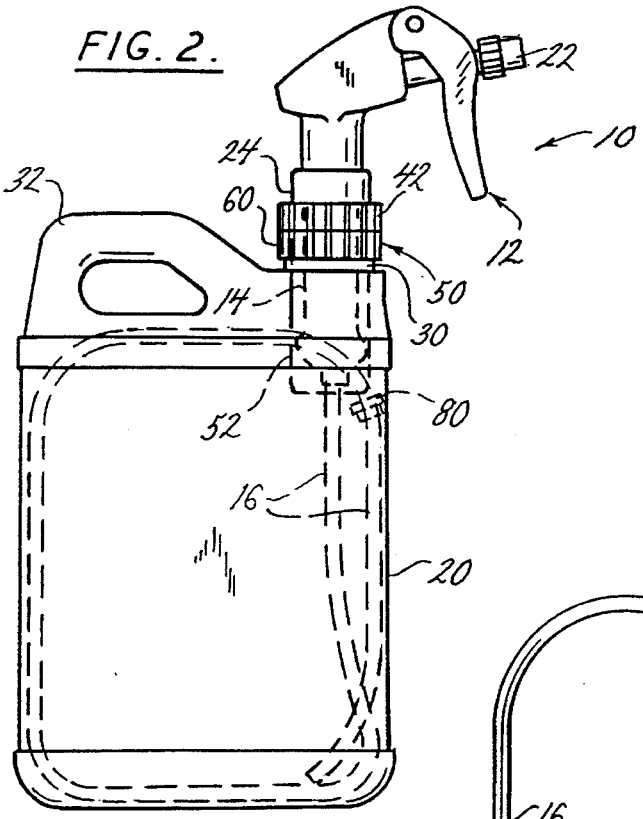
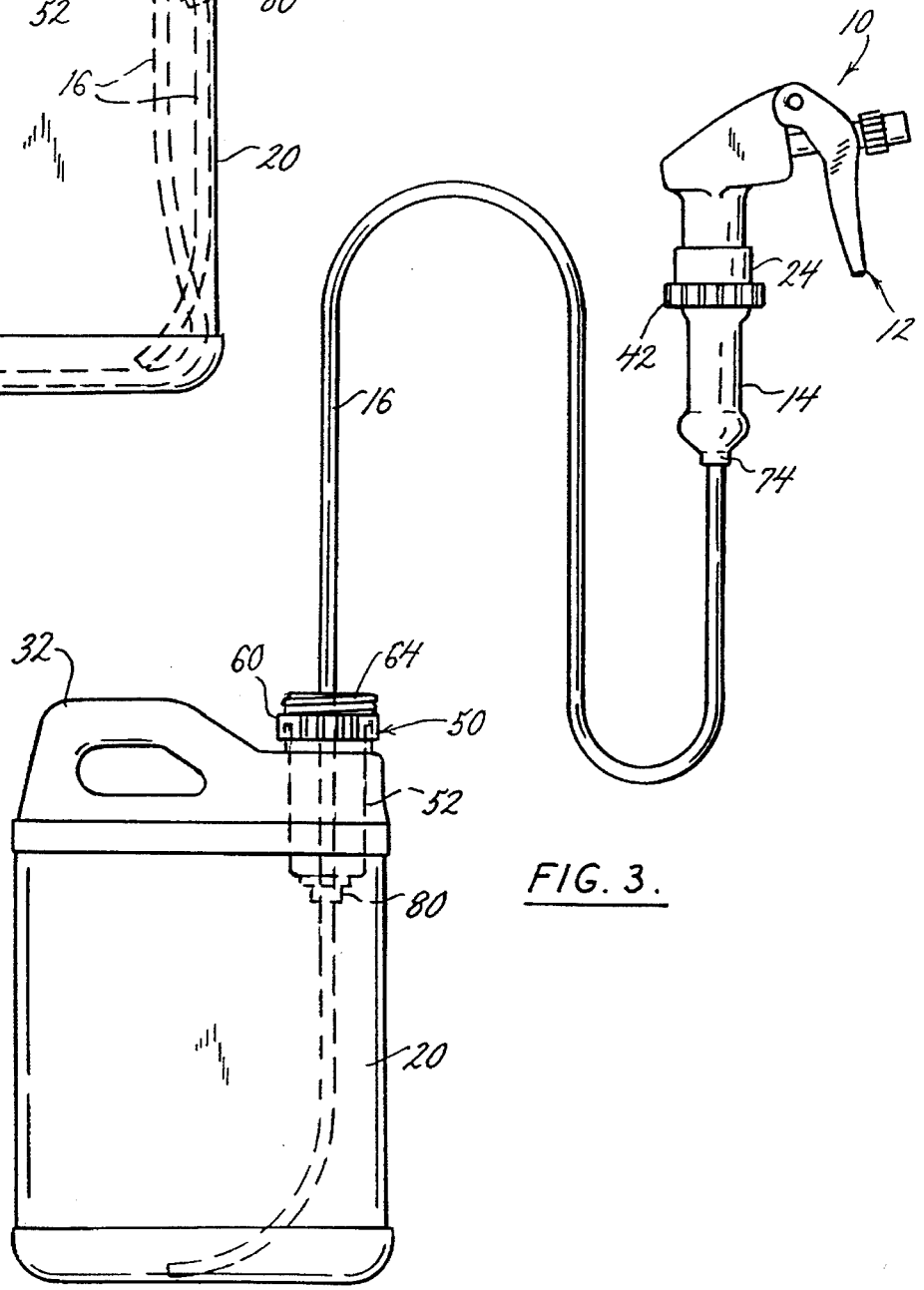
FIG. 3.

22
12
18
10
24
42
60
30
32
90
110
112
114
20
64

LIQUID DISPENSER ASSEMBLY WITH CONTAINER HAVING A SLOPED HANDLE

This application is a divisional application of U.S. application Ser. No. 08/227,565, filed Apr. 14, 1994, now issued as U.S. Pat. No. 5,373,973; which is a file wrapper continuation of U.S. application Ser. No. 07/984,876, filed on Dec. 2, 1992, and now abandoned; which is a continuation-in-part application of U.S. application Ser. No. 07/829,759, filed Jan. 31, 1992, and now abandoned.

BACKGROUND AND SUMMARY OF INVENTION

This invention relates to a liquid dispenser assembly, and particularly such an assembly for use with a liquid container and where the dispenser is operated remotely from the container. A tube connects the dispenser with the container for feeding the liquid to the dispenser. The present invention is an improvement over remotely operated dispensers of the type described above, and further includes a unique adaptor secured to the container and to which the dispenser may be connected for sale and storage and disconnected for remote operation.

Liquid dispenser assemblies of the type to which this invention is generally directed are well-known in the art. The dispenser assembly shown in FIG. 1 of the drawing is typical of the prior art. The dispenser assembly of the prior art includes a trigger sprayer 12 having a neck portion 13, a handle portion 14 that is exposed and readily accessible for gripping by a user's hand and a tube 16. The trigger dispenser 12 is of the type well-known in the art and which is operable by means of a trigger 18 to pump liquid from a suitable container, such as container 20, and out a nozzle and orifice cap 22 of the dispenser. The cap 22 may be fixed or may be adjustable to provide a variety of spray patterns, all of which is well-known. The dispenser assembly 10 also includes a threaded closure 24 to connect the handle portion to the neck portion of the dispenser.

The container 20 is of a type typically found in retail stores and may be of plastic and have a threaded neck or rim 30 and handle portion 32 for carrying and holding the container. When the container and dispenser assembly are packaged for retail sale in the stores, the container has a threaded cap 34 with a hole 36 in the top. A gasket 38 is located between the cap and the threaded neck 30 of the bottle to seal the opening and prevent the liquid within the bottle from spilling. When packaged for sale in the store, typically the dispenser assembly, including the trigger sprayer 12, portion 14, and tube 16, are packaged in a sealed plastic bag. The bag has a hole so that the bag containing the dispenser assembly may be hung over the neck 30 of the container with the cap 34 extending through the hole. To use the prior art assembly of FIG. 1, the user removes the plastic bag from the container, and removes the dispenser assembly from the plastic bag. The user then inserts the end of the tube 16 through the hole 36 and pierces the gasket 38, thus inserting the tube into the liquid within the container. The user holds the container with one hand while operating the trigger sprayer with the other to pump the liquid from the container and out the dispenser. The container and dispenser assembly of FIG. 1 typically are used to dispense products such as insecticides, herbicides, and the like.

There are several disadvantages associated with the container and dispenser assembly of FIG. 1. Once the gasket is pierced, if the container is tipped over during use, the liquid within the container will leak between the tube and gasket and between the tube and opening 36. Another disadvantage is that the dispenser assembly is awkward to store and there is no provision for sealing the container. Still another disadvantage is that the plastic bags containing the dispenser assemblies frequently become separated from the containers in the retail store creating customer confusion and annoyance. The present invention overcomes these problems.

In accordance with the present invention, there is provided an adaptor that is secured to the neck portion of the container. While the adaptor may be disconnected from the container, it remains connected to it when sold in the stores, when in use, and when the dispenser is stored during non-use. The dispenser and adaptor have means for connecting the dispenser and adaptor together with the tube extending from the dispenser, through the adaptor, and into the container. The dispenser may be disconnected from the adaptor while the adaptor remains secured to the container, for operation of the dispenser remotely from the container. The tube extends through the adaptor in sealing engagement therewith to prevent liquid from entering the interior of the adaptor. Thus, the interior of the adaptor remains dry and sealed from the liquid. When the dispenser assembly is connected to the adaptor, the handle portion of the dispenser extends into the interior of the adaptor and remains dry and out of contact with the liquid. In use where the dispenser is disconnected from the adaptor and operated remotely, the adaptor remains secured to the container to provide a seal against spilling.

In one preferred embodiment of the invention, the adaptor has a chamber therein. The tube has a preformed coil portion housed within the chamber with the dispenser and adaptor connected. The coil portion extends upon disconnecting the dispenser from the adaptor for remote operation of the dispenser. This embodiment has the advantage that the exterior surface of the preformed coiled tube portion which may come in contact with the user during use, is protected from the liquid, it being housed within the adaptor chamber.

These and other advantages of the invention are apparent from the drawing and detailed description to follow.

DESCRIPTION OF THE DRAWINGS

FIG. 2 is a side elevational view of a liquid dispenser assembly with adaptor of the present invention shown with the dispenser assembly connected to the adaptor for sale in the stores or storage.

FIG. 3 shows the dispenser assembly of FIG. 2 but with the dispenser assembly disconnected from the adaptor for use by remote operation of the dispenser assembly.

DETAILED DESCRIPTION OF PREFERRED EMBODIMENTS

Figure 1:
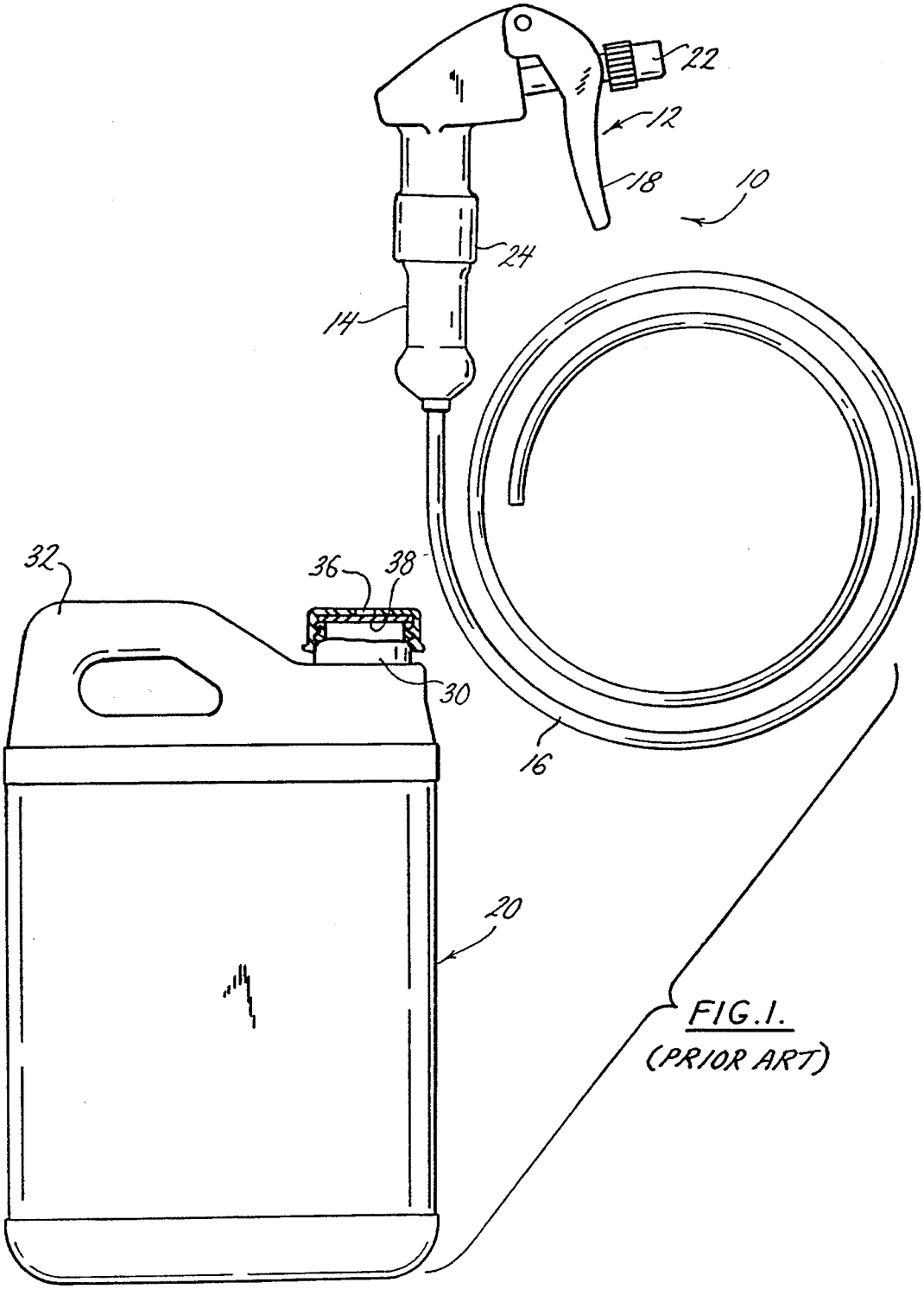
FIG. 1. (PRIOR ART)
FIG. 1 shows a dispenser assembly and container of the prior art.
Figure 4:
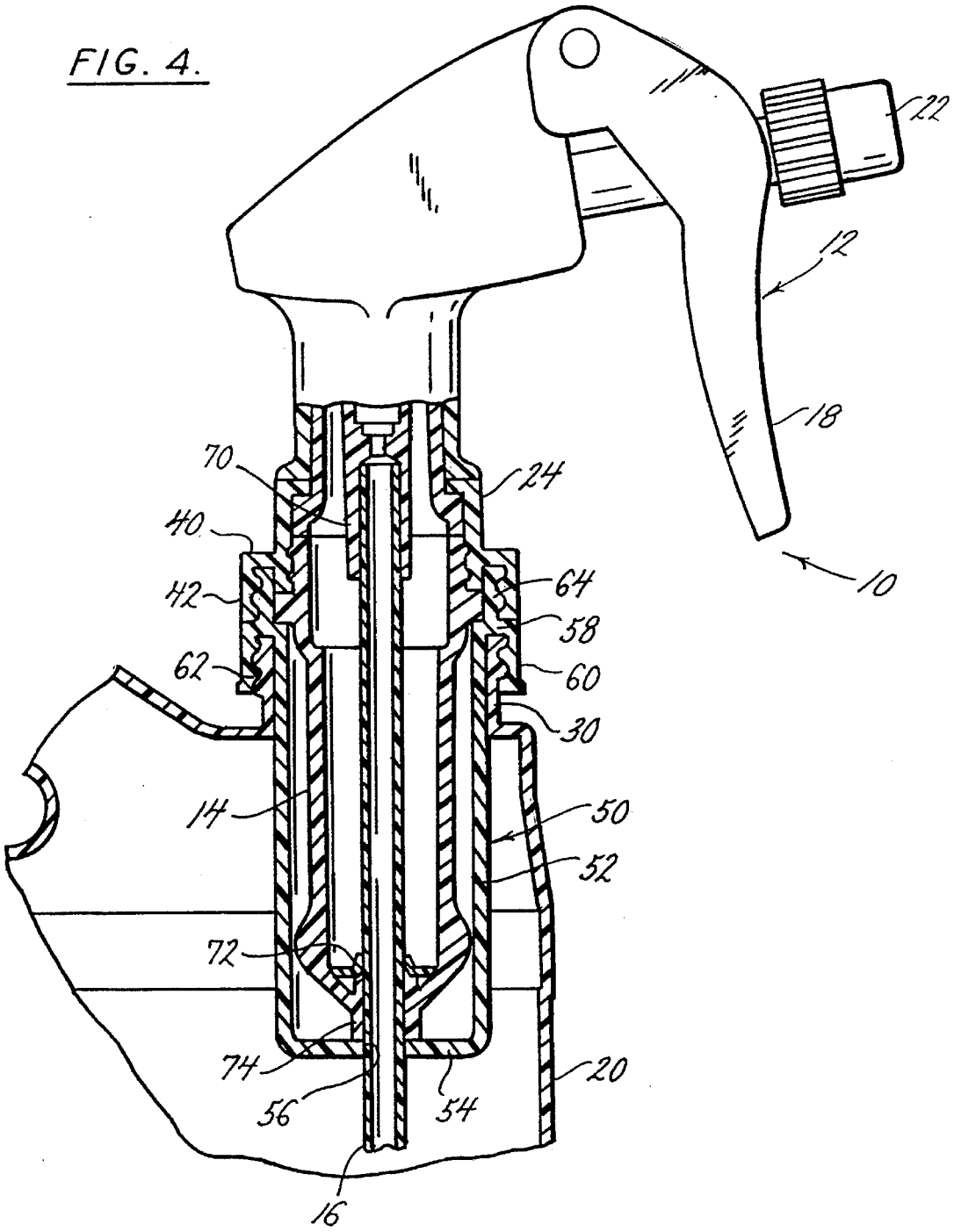
FIG. 4 is a view in partial section of the dispenser assembly and adaptor of FIG. 2 shown with the dispenser assembly connected to the adaptor.

With reference to the drawing, one preferred embodiment of the liquid dispenser assembly with adaptor of the present invention is shown in FIGS. 2–4. Generally, the dispenser assembly is the same as shown in FIG. 1 except that the closure 24 has an outwardly extending shoulder 40 and an internally threaded ring portion 42 depending therefrom. The container 20 is also the same but does not include the cap 34 or gasket 38 as these are not used with the present invention. An adaptor 50 is generally cup-shaped and has a cylindrical tubular portion 52 and a bottom 54 with a central opening 56 therethrough. At the top of the cylindrical portion 52 is a shoulder 58 with a ring portion 60 depending therefrom. The ring portion 60 has internal threads 62 that mate with the threaded neck 30 of the container. Extending upwardly from the shoulder 58 is an externally threaded ring 64. The threads of the ring 64 mate with those of the threaded ring 42 of closure 24 of the dispenser assembly.

The tube 16 is connected within the neck and handle portions of the dispenser. The upper end of the tube is connected to a fitting 70 such that liquid pumped through the tube is fed through suitable passages within the trigger dispenser as is well-known in the art. The tube is further supported at the lower end of the handle portion by means of a bracket 72 and an extended cylindrical portion 74 to provide sealing engagement between the tube and the lower end of the handle portion. The tube 16 fits within the opening 56 at the bottom of the adaptor. The opening is somewhat undersized to provide a tight-fit engagement while allowing the tube to be pushed and pulled through the opening. The tube is preferably of plastic and is flexible and somewhat forgiving to allow the tube to be pushed and pulled through the opening and yet provide a liquid-tight seal.

The dispenser assembly and container of FIGS. 2–4 are sold in the retail stores with the adaptor secured to the container and with the dispenser assembly connected to the adaptor as shown in FIGS. 2 and 4. There is little or no likelihood of the dispenser assembly becoming inadvertently separated from the container as frequently occurred with the prior art arrangement.

To use the dispenser assembly, the dispenser assembly is disconnected from the adaptor, leaving the adaptor secured to the container. The tube is pulled from the container through the opening 56 while leaving a sufficient length of tube extending into the liquid as shown in FIG. 3. Typically, the user operates the dispenser assembly by holding the container in one hand while remotely operating the dispenser with the other to pump liquid from the container and through the nozzle and cap 22 of the dispenser. Preferably, a retainer clip 80 is secured to the tube to act as a stop so that the user does not inadvertently pull all of the tube from the container, but instead leaves a sufficient length of tube within the liquid as shown in FIG. 3.

To store the dispenser assembly and container after use, the tube is pushed back through the opening 56 and into the container, and the dispenser assembly is again connected to the adaptor by screwing the closure 24 onto the threaded ring 64 of the adaptor. The assembly is sealed against leakage both while in use and storage.

Figures 5, 6:
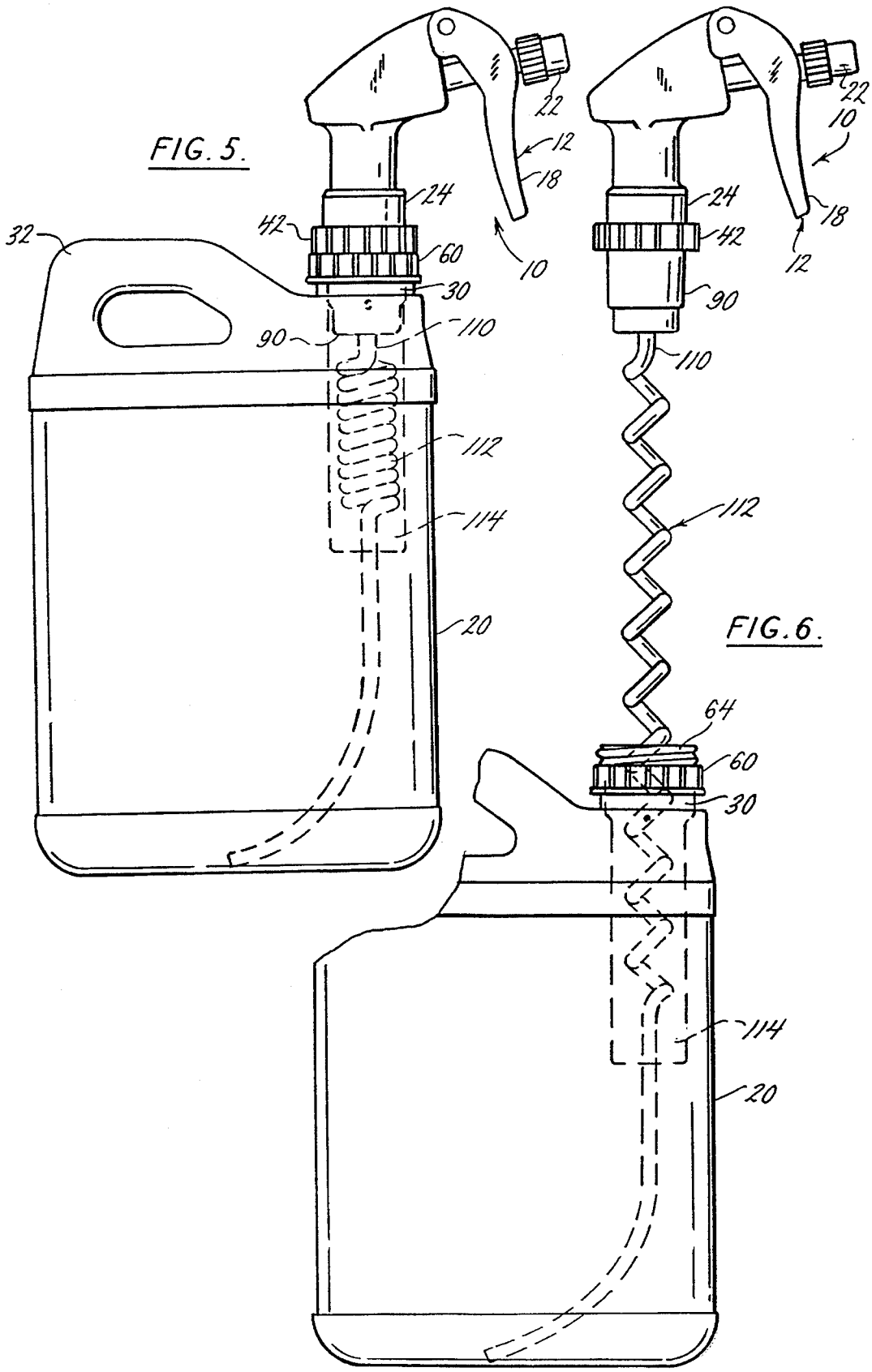
FIG. 5 is a view similar to FIG. 2 but showing another preferred embodiment of the invention.
FIG. 6 is a view showing the embodiment of FIG. 5 but with the dispenser assembly disconnected from the adaptor for use by remote operation of the dispenser.
Figure 7:
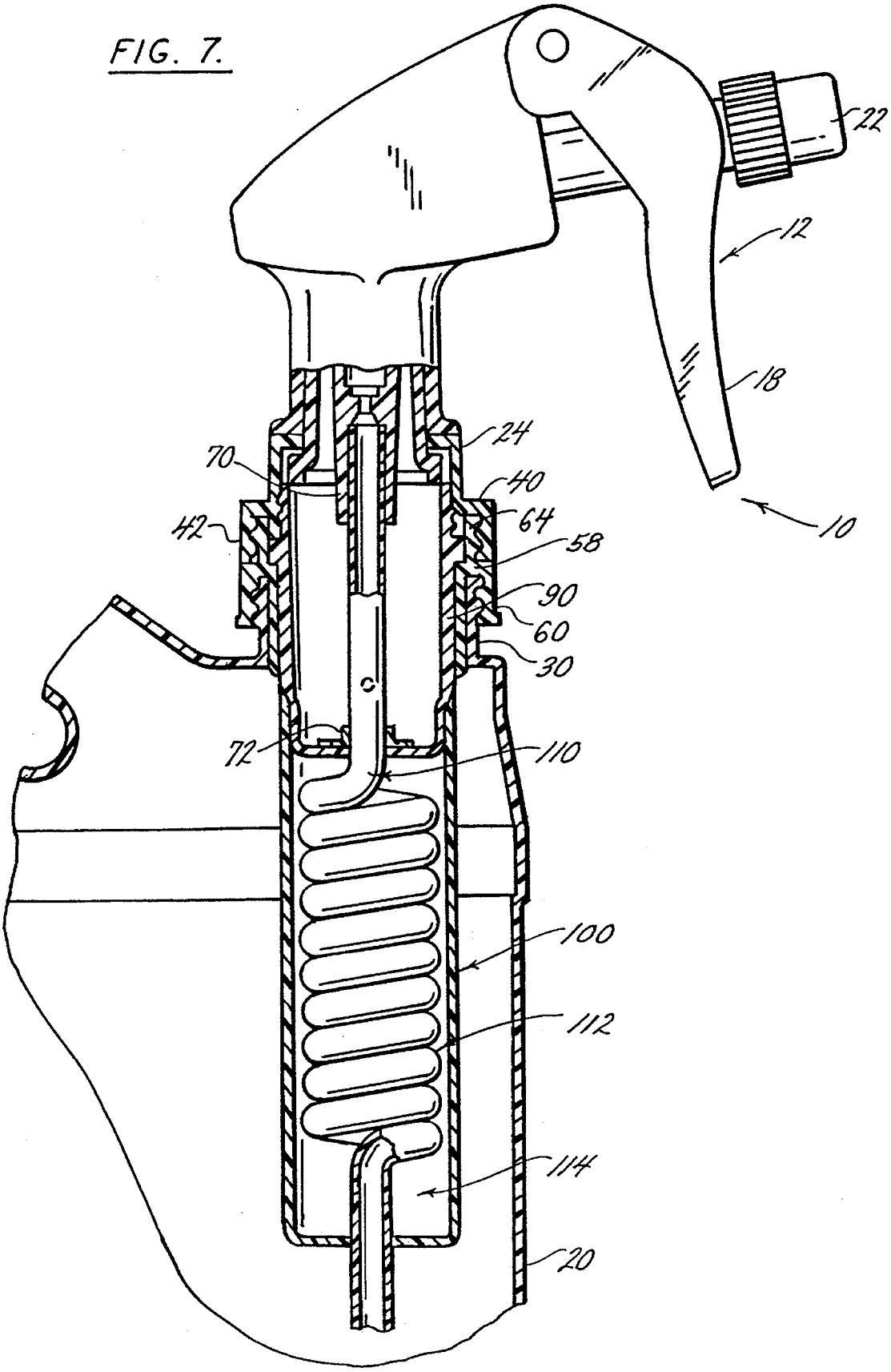
FIG. 7 is a view in partial section of the dispenser assembly and adaptor of FIG. 5.

Another preferred embodiment of the invention is shown in FIGS. 5–7. This embodiment is the same as the one shown in FIGS. 2–4 except as will be explained.

The sprayer assembly of this embodiment also has a handle portion 90 similar to the handle portion 14 of the embodiment of FIGS. 2–4, but is somewhat shorter. The dispenser assembly of this embodiment also has-an adaptor 100 similar to the adaptor 50 of the previous embodiment but is substantially longer. The dispenser assembly of this embodiment also has a tube 110 similar to the tube 16 of the previous embodiment except that it has a preformed coil portion 112 housed within a chamber 114 within the adaptor, the chamber being defined within the adaptor beneath the handle portion 90 of the dispenser. The upper end of the tube extends into the handle and neck portions of the dispenser and is secured thereto as with the first described embodiment. Also as with the first described embodiment, the tube extends in a tight-fit engagement through an opening at the bottom of the adaptor.

The operation and use of the dispenser assembly and adaptor of this embodiment is similar to that of the first described embodiment, except that when the dispenser assembly is disconnected from the adaptor for remote operation of the dispenser, the preformed coil portion 112 of the tube extends as shown in FIG. 6, rather than the tube being pulled through the opening at the bottom of the adaptor as-with the first described embodiment. To place the dispenser assembly back in its stored position, the preformed coil portion is allowed to collapse as in FIGS. 5 and 7 to be housed in the chamber 114 with the dispenser assembly connected to the adaptor. The primary advantage of this embodiment is that the lower portion of the tube in contact with the liquid is never pulled from the container where it might contact the user, and the portions of the tube that are contacted by the user always remain segregated from the liquid.

Still another preferred embodiment of the present invention is shown in FIGS. 8–12. Generally, this embodiment is the same as the one shown in FIGS. 5–7 except as will be explained.

Figure 11:
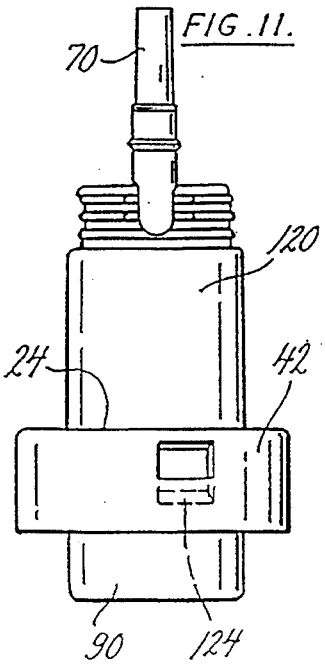
FIG. 11 is a front elevation view of the valve case of FIG. 9.
Figure 12:
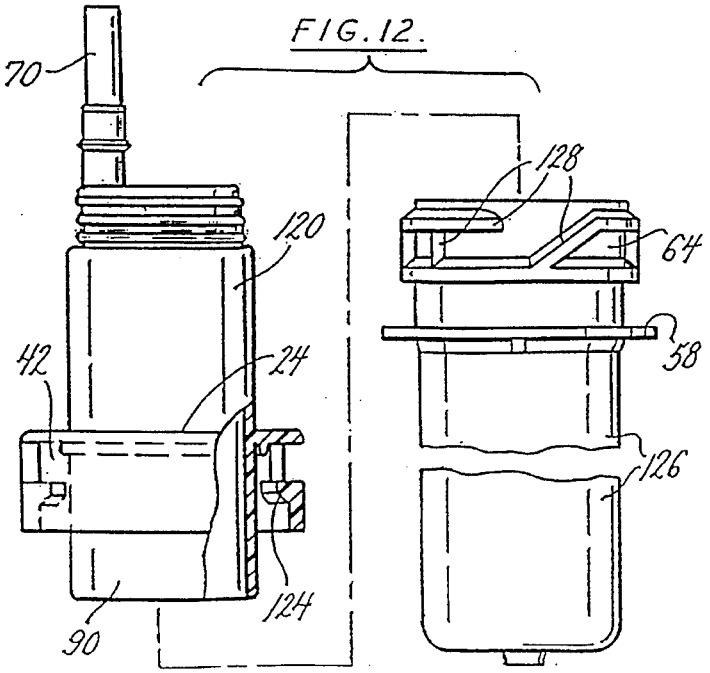
FIG. 12 is an exploded view, showing a side elevation of the valve case in partial section and showing the adaptor partly broken away.

The dispenser assembly of this embodiment has a valve case 120 which is integrally molded as one-piece, and which performs the functions of the handle portion 90, the threaded closure 24, and the fitting 70 of FIG. 7. The valve case 120 includes an inverted-cup shaped portion 121 that defines a central cavity 122. The ring portion 42 of this valve case 120, as better shown in FIGS. 11 and 12, is formed with opposite inwardly projecting tabs 124.

The dispenser assembly of this embodiment also has an adaptor 126 similar to the adaptor 100 of FIG. 7 except that the adaptor 126 is shorter, and the shoulder 58 does not include the depending ring portion 60. As better shown in FIG. 12, the adaptor 126 has the top portion 64 formed with bayonet-type provisions 128 which mate with the tabs 124 of the valve case 120. The adaptor 126 includes a collar 130 that is rotatably mounted on the shoulder 58 and has internal threads that mate with the threaded neck 30 of the container. The adaptor 126 has a vent 131.

Figure 8:
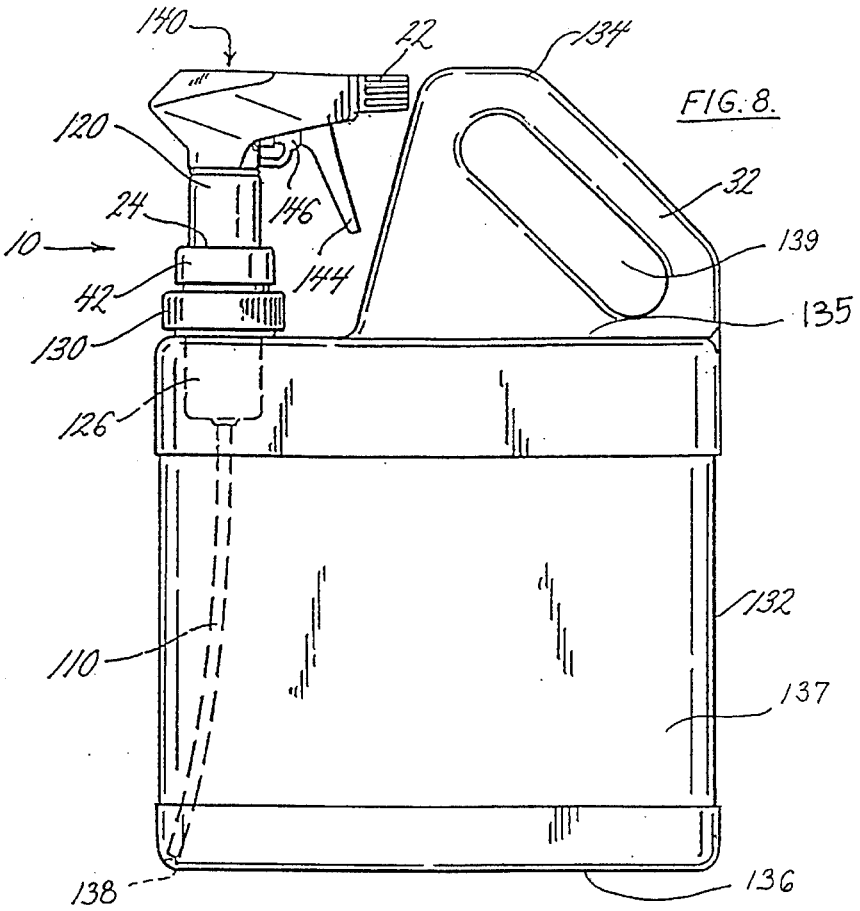
FIG. 8 is a view similar to FIGS. 2 and 5 but showing still another preferred embodiment of the present invention.

This embodiment of the present invention includes a container 132 similar to the container 20 of FIGS. 1–7 except that this container 132 has a crown portion 134 that extends at least to the top of the dispensing assembly, as shown in FIG. 8, and preferably a top surface of the crown is positioned somewhat above the top. The container 20 is comprised of a top wall 135, a bottom wall 136, and a sidewall 137 that extends between the top and bottom walls. Together, the top wall, bottom wall, and sidewall all surround an interior volume of the container. The container bottom wall 136 and sidewall 137 meet at a corner 138 that extends around the periphery of the bottom wall. As seen in FIG. 8, with the sprayer dispenser 140 secured to the container top wall 135 with the dip tube 110 extending through the access opening of the container, the distal end of the dip tube is positioned directly beneath the container opening and adjacent the corner 138 joining the bottom wall and the sidewall. The container crown 134 projects upwardly from the container top wall 135 adjacent the sprayer dispenser 140 when the dispenser is secured to the container. The crown 134 is hollow and a portion of the container interior volume extends into the crown. The handle 32 is formed in the crown by an oblong opening 139 that passes through the crown. The oblong opening 139 is dimensioned sufficiently large to enable the insertion of the fingers of a hand through the opening when gripping the handle 32 of the container. Both the handle 32 and oblong opening 139 have center axes that extend at an angle relative to the container top wall 135 and bottom wall 136. Also, the container 132 has the handle portion 32 sloped as shown in FIG. 8. The container 132 is provided with the sloping handle portion 32 so that when the container is carried and liquid is in the container, the liquid will settle in the opposite bottom corner where the inlet to the dip tube 110 is located. This insures that during use, while the container is held in one hand and the sprayer in the other, the inlet to the dip tube 110 will be below the liquid level, even when the liquid level is drawn low. The crown portion 134 extends as high as or higher than the top of the dispensing head 140 to act as protection during shipment, storage, and the like. The crown portion 134 is located toward the vertical center of the container so that the container and its liquid contents will balance it upside down.

The dispensing assembly of this embodiment has a dispensing head 140. Both the dispensing head 140 and the trigger dispenser 12 are well-known in the art. Although the dispensing head 140 is more particularly shown here, it is merely representative of pump sprayers in general, and it is to be understood that there are many variations of dispensers that may be used with this invention, dispensers 12 and 140 being only examples.

The dispensing head 140 is an operable assembly which includes a housing 142, a trigger 144, a plunger 146, a spring 148, a spinner assembly 150, and the nozzle and orifice cap 22. The housing 142 is a molded piece that defines several chambers, including a vertical chamber 152, a horizontal chamber 154, a piston chamber 156 and a vent chamber 158 reciprocally receiving a vent piston 160. The wall of the vent chamber has a vent opening 162 which (with the vent opening 131) vents the container when the vent piston is retracted (moves to the left as viewed in FIG. 9) upon pulling the trigger 144. The fitting end 70 of the valve case 120 is press fitted into the vertical chamber 152. The trigger 144 has its upper end pivotally supported by the housing 142 by means of oppositely extending lugs (not shown, but which extend into and out of the view of FIG. 9) which pivot within recesses in spaced side panels of the housing 142. Manually operating the trigger 144 causes the pumping of liquid through the tube from the container for ejection out the nozzle and orifice cap 22, as is well-known in the art.

With the bayonet-type connection between the valve case 120 and the adaptor 126, the valve case 120 can either be snapped directly onto the adaptor 126, or connected by orienting the dispensing head 140 at 90° to the container crown 134 and then rotating the dispensing head 140 a quarter turn until the dispensing head 140 is aligned with the container crown 134 as shown in FIG. 8. The dispensing head 140 is mounted to the container 132 in the proper orientation by virtue of the adjustability provided by the collar 130. Thereafter, the dispensing head 140 is connected and disconnected to the adaptor 126 by means of the bayonet connection so that the dispensing head 140 is easily oriented to the same position for storage. The bayonet provisions 128 of the adaptor 126 and the threads of the collar 130 tighten in opposite directions so that rotation of the tabs 124 to disconnect the dispensing head 140 tends to tighten the collar 130 onto the threaded neck 30. The collar 130 and neck 30 may also be adapted to be connected with bayonet type provisions, but preferably at least the valve case 120 and adaptor 126 connect by bayonet type connections for ease and orienting the dispensing head 140.

Figure 9:
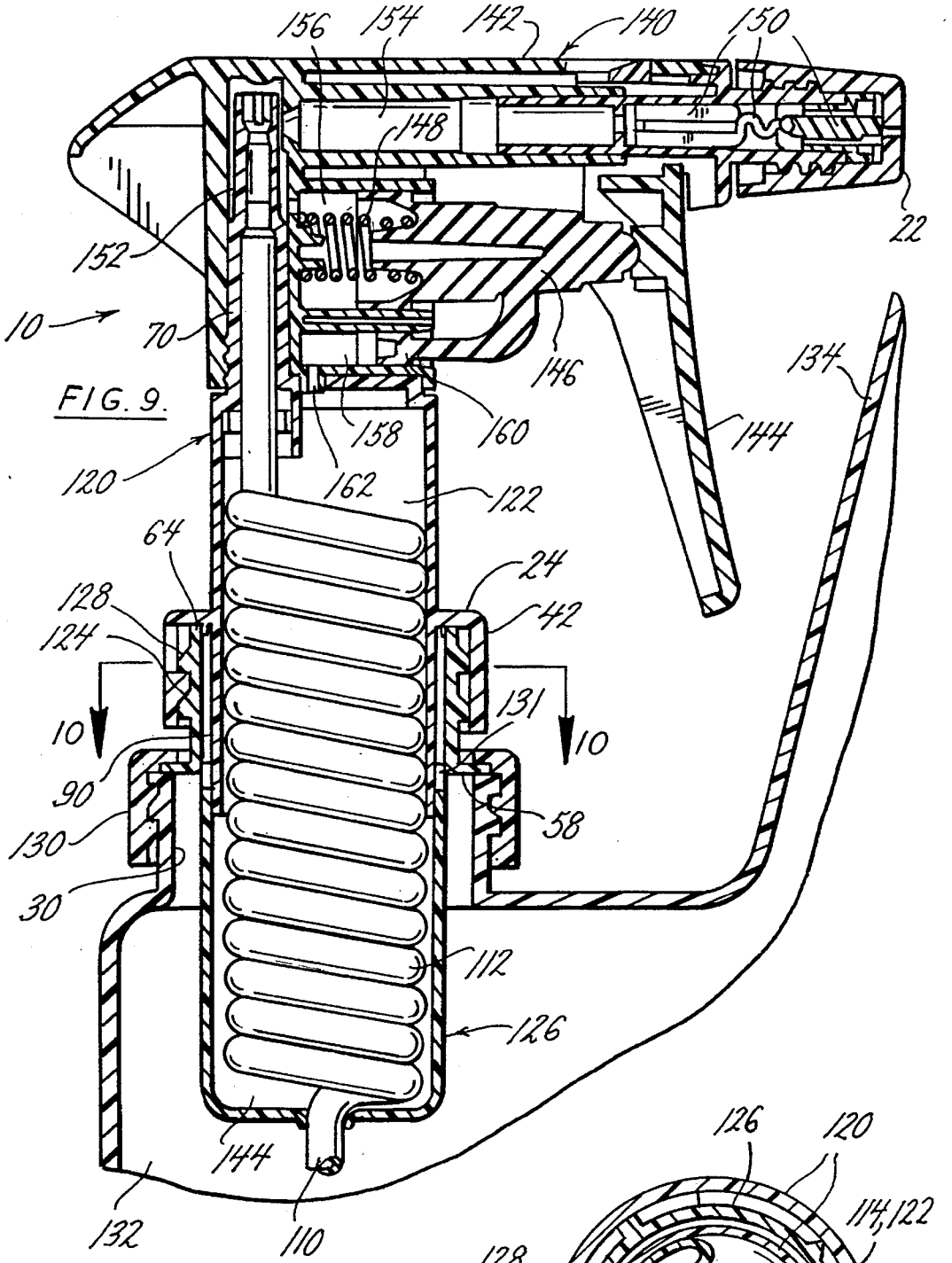
FIG. 9 is a view in partial section of the dispenser assembly and adaptor of FIG. 8.
Figure 10:
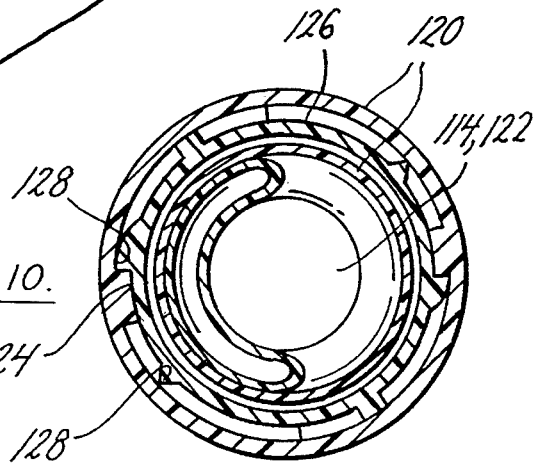
FIG. 10 is a section view taken along the line 10—10 of FIG. 9.

The operation and use of the dispenser assembly and adaptor 126 of FIGS. 8–12 are similar to that of the embodiment of FIGS. 5–7, except that the cavity 122 of the valve case 120 cooperates with the chamber 114 of the adaptor 126 for housing the preformed coils 112 of the tube, as shown in FIGS. 9 and 10.

While the present invention has been described by reference to Specific embodiments, it should be understood that modifications and variations of the invention may be constructed without departing from the scope of the invention defined in the following claims.

What is claimed is:

1. In combination, a container and a sprayer dispenser having a dip tube, the combination comprising:

a sprayer dispenser having a dip tube;

a container body having a top wall and a bottom wall and at least one sidewall extending between the top wall and bottom wall, the top wall, bottom wall and sidewall all surrounding an interior volume of the container;

an opening in the top wall of the container, the opening being dimensioned to receive the dip tube of the sprayer dispenser therethrough;

means on the container for securing the sprayer dispenser on the top wall of the container with the dip tube inserted through the top wall opening; and, a crown formed in a portion of the container top wall adjacent the top wall opening, the crown projecting from the top wall adjacent to an beyond the sprayer dispenser when the sprayer dispenser is secured to the container top wall.

2. The combination of claim 1, wherein:

the crown is hollow and the interior volume of the container extends into the crown.

3. The combination of claim 1, wherein:

the crown has a handle formed thereon and the handle has a center axis that is positioned at an angle relative to the bottom wall of the container.

4. The combination of claim 3, wherein:

the center axis of the handle is positioned at an angle relative to the top wall of the container.

5. The combination of claim 1, wherein:

the container has a corner where the bottom wall and sidewall come together, the corner is positioned below the container opening;

the crown has a handle formed thereon and the handle has an orientation relative to the container that causes the container corner to be positioned at a lower most point of the container when the container is suspended from the handle.

6. The combination of claim 5, wherein:

the corner is positioned directly below the container opening so that the dip tube of the sprayer dispenser will extend into the corner when the sprayer dispenser is secured to the container.

7. The combination of claim 1, wherein:

the crown has an opening therethrough positioned below the handle, the opening is sufficiently large to enable insertion of fingers of a hand therethrough when the container is suspending from the handle by the hand; and the container has a corner where the bottom wall and sidewall come together, and the corner is positioned at a lower most point of the container when the container is suspended by the hand from the handle.

8. The combination of claim 1, wherein:

the crown has a configuration that, when the container is supported by its bottom wall on a horizontal surface, a top surface of the crown is positioned above the sprayer dispenser when the sprayer dispenser is secured to the container.

9. In combination, a container and a sprayer dispenser having a dip tube, the combination comprising:

a sprayer dispenser having a did tube;

a container body having a top wall and a bottom wall and at least one sidewall extending between the top wall and bottom wall, the top wall, bottom wall and sidewall all surrounding an interior volume of the container, and the container having a corner where the bottom wall and sidewall come together;

an opening in the top wall of the container, the opening being dimensioned to receive the dip tube of the sprayer dispenser therethrough;

means on the container for securing the sprayer dispenser on the top wall of the container with the dip tube inserted through the top wall opening and extending to a distal end of the dip tube positioned adjacent the container corner; and a crown formed in a portion of the container top wall adjacent the top wall opening, the crown projecting from the top wall and having a handle formed thereon, and the handle having an orientation relative to the container that causes the container corner to be positioned at a lower most point of the container when the container is suspended from the handle.

10. The combination of claim 9, wherein:

the container handle has a center axis that is positioned at an angle relative to the bottom wall of the container.

11. The combination of claim 9, wherein:

the container handle has a center axis that is positioned at an angle relative to the top wall of the container.

12. The combination of claim 9, wherein:

the container corner is positioned directly below the container opening so that the dip tube of the sprayer dispenser will extend into the corner when the sprayer dispenser is secured to the container.

13. The combination of claim 9, wherein:

the crown has an opening therethrough positioned below the handle, the opening is dimensioned to enable insertion of fingers of a hand therethrough when the container is suspended from the handle by the hand.

14. The combination of claim 9, wherein:

the crown has a configuration that, when the container is supported by its bottom wall on a horizontal surface, a top surface of the crown is positioned above the sprayer dispenser when the sprayer dispenser is secured to the container.

15. The combination of claim 9, wherein:

the crown is hollow and the interior volume of the container extends into the crown.

* * * * *